US006380907B1

(12) United States Patent
Ku et al.

(10) Patent No.: US 6,380,907 B1
(45) Date of Patent: Apr. 30, 2002

(54) BOXED STRUCTURE ANTENNA DEVICE

(75) Inventors: Kao-Tong Ku, Hsin Chu; Chieh Yang, yeong-Her, both of (TW)

(73) Assignee: Pro Broadband Inc., Hsin Chu (TW)

( * ) Notice: Subject to any disclaimer, the term of this patent is extended or adjusted under 35 U.S.C. 154(b) by 0 days.

(21) Appl. No.: 09/826,830

(22) Filed: Apr. 6, 2001

(30) Foreign Application Priority Data

Oct. 13, 2000 (CN) ..... 89217830 U

(51) Int. Cl.[7] ..... H01Q 13/00
(52) U.S. Cl. ..... 343/840
(58) Field of Search ..... 343/700 MS, 702, 343/780, 872; 455/90

(56) References Cited

U.S. PATENT DOCUMENTS 4,876,554 A * 10/1989 Tubbs ..... 343/780
5,486,837 A * 1/1996 Miller ..... 343/780

* cited by examiner

*Primary Examiner*—Tan Ho
(74) *Attorney, Agent, or Firm*—Rabin & Berdo, P.C.

(57) ABSTRACT

This invention relates to an antenna device boxed structure, in which the PC board fitted to a radiant plate, the intermediate plate is fixed between the upper and lower boxes, and the grooves of the upper and lower sheaths are closely fixed with the convex block in the base seat. This allows the structure to rotate freely and smoothly with appropriate elasticity of the plastic for adjusting angles.

4 Claims, 6 Drawing Sheets

BOXED STRUCTURE ANTENNA DEVICE

TECHNICAL FIELD

The invention relates to a boxed structure antenna device having three layers—a radiant plate, a printed circuit board (PC board) and an intermediate plate—for influent receiving and transmitting radio frequency (RF) without any cable connection between antenna and circuit board, which will replace the conventional antenna assembly. The base seat of this boxed structure provides lots of advantages—easily assembled and collected, and it can be placed on all kinds of planes, as well as angle-scale adjustable.

BACKGROUND OF THE PRESENT INVENTION

Please refer to the FIG. 1. Normally, a conventional antenna used a flexible cable to connect to a metallic radiant element. One end of the cable was connected with one fixed terminal on the PC board, and the other end was connected with the terminal of the patch antenna. With this conventional one, its PC board had been set on the base seat, and the patch antenna had to be set in a box for convenient connecting the PC board with a high frequency coaxial cable connected in between. However, in order to receive radio frequency from different directions, the patch antenna has to be altered to different directions and angles of elevations. Therefore the seat base and the box shall be jointed by a rotational component and a deviated element. Please refer to FIG. 1. The conventional patch antenna (11) is allocated at the upper portion of the box, which is connected by a deviated element (13) and a rotational component (12), the latter being fixed on the box by a pivot. The cable (10) passed the rotational component (12) and then through the deviated element (13), finally reaching the patch antenna (11). Nevertheless, constant adjusting and rotating angles of the rotational component (12) and the cable (10), which may fall apart or become loose, caused a poor connection and fault signal transmission.

Furthermore, the electrical cable (10) has to pass the rotational component (12) and through the deviated element (13) during assembling, which required complicated procedures and manual operations. Thus, slowed and reduced the producing speed and efficiency, apparently, a bottleneck of manufacture and increasing cost will be occurred. The cable has to penetrate the rotational components through deviated elements. This makes assembly difficult and may allow the rotational element and the cable to become loose after they are connected. Furthermore, defectives in the utilizing and manufacturing may result.

The invertors have experience in designing and manufacturing antennas as well as related products. Since the patch antenna has to be easily regulated to all aspects and angles, if any antenna could be fixed in a secured box with an integrated PC board, there would be no problem in the junction elements becoming loose or poor connections.

SUMMARY OF THE INVENTION

The primary purpose of the invention is to consolidate the PC board with the radiant plate and intermediate plate as an integrated multi-layer, which can be placed in a box for replacing other cables and for receiving and transmitting high frequency signals.

The secondary purpose of the invention is to facilitate the positioning of the box and the base seat. The invention could be easily adjusted to different angles to receive and transmit signals for the groove of the upper and lower sheaths is well matching with the convex block of the base seat. Thus, regulating the elements can be smooth and quiet for the result of those elements being used of the characteristics of plastic—elastic, moldable, and light. Additionally, the base seat is able to be positioned or hung on various planes and places for multi-scale utilities.

BRIEF DESCRIPTION OF THE DRAWING

In order to provide the examining committees a better understanding the purposes, features, and functions of the invention, hereinafter are practical examples and graphic drawings.

BRIEF DESCRIPTION OF THE TERMS

| | | | |
|---|---|---|---|
| upper sheath | (20) | storage space | (21) |
| slider | (22) ' (23) | inner and outer slot | (24) ' (25) |
| groove | (26) | bearing | (27) |
| arc shape concave | (271) | | |
| lower sheath | (30) | concave groove | (34) |
| allowance gap | (35) | concave space | (36) |
| hollow hole | (352) ' (353) | | |
| base seat | (40) | convex block | (41) |
| protrude bar | (42) | convex edge | (43) |
| hub | (44) | notch | (45) |
| gap | (46) | metal plate | (47) |
| long groove | (48) | | |
| PC board | (50) | electrical element | (51) |
| channel switch | (52) | power switch | (53) |
| switch block | (521) ' (531) | | |
| signal connector | (54) | power connector | (55) |
| radiant plate | (56) | intermediate plate | (57) |
| power cable | (58) | signal cable | (59) |

DETAILED DESCRIPTION OF THE INVENTION

Figure 1:
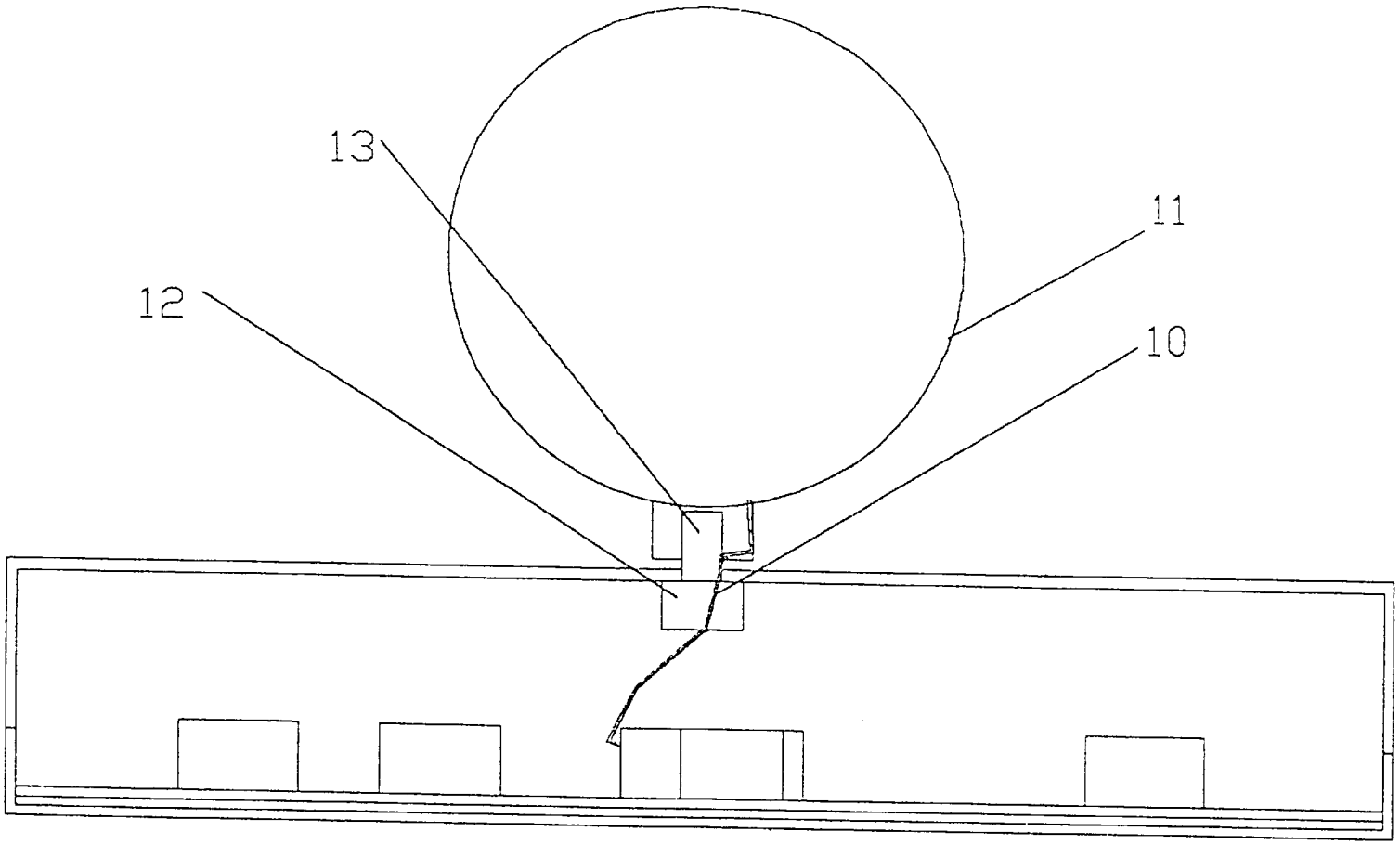
FIG. 1 Prior Art
FIG. 1 is a conventional antenna device.
Figure 2:
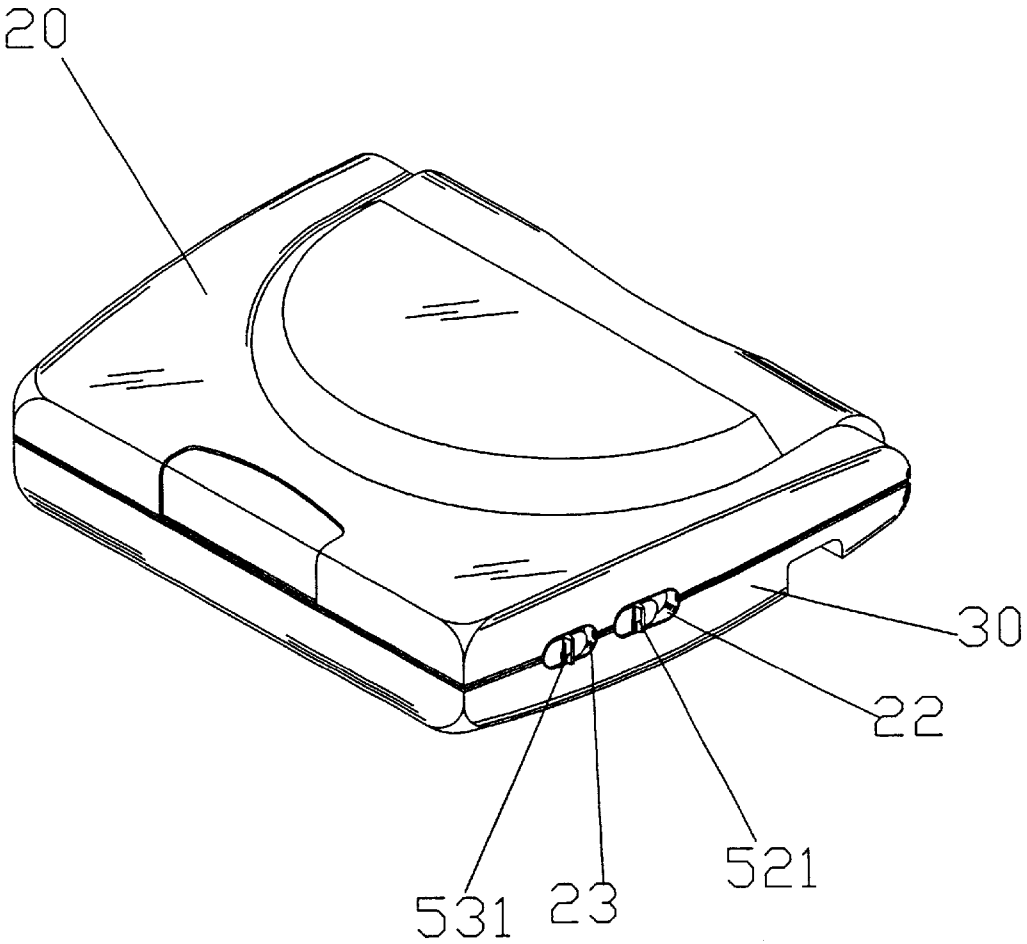
FIG. 2 is a three-dimensional view of the invention
Figure 3:
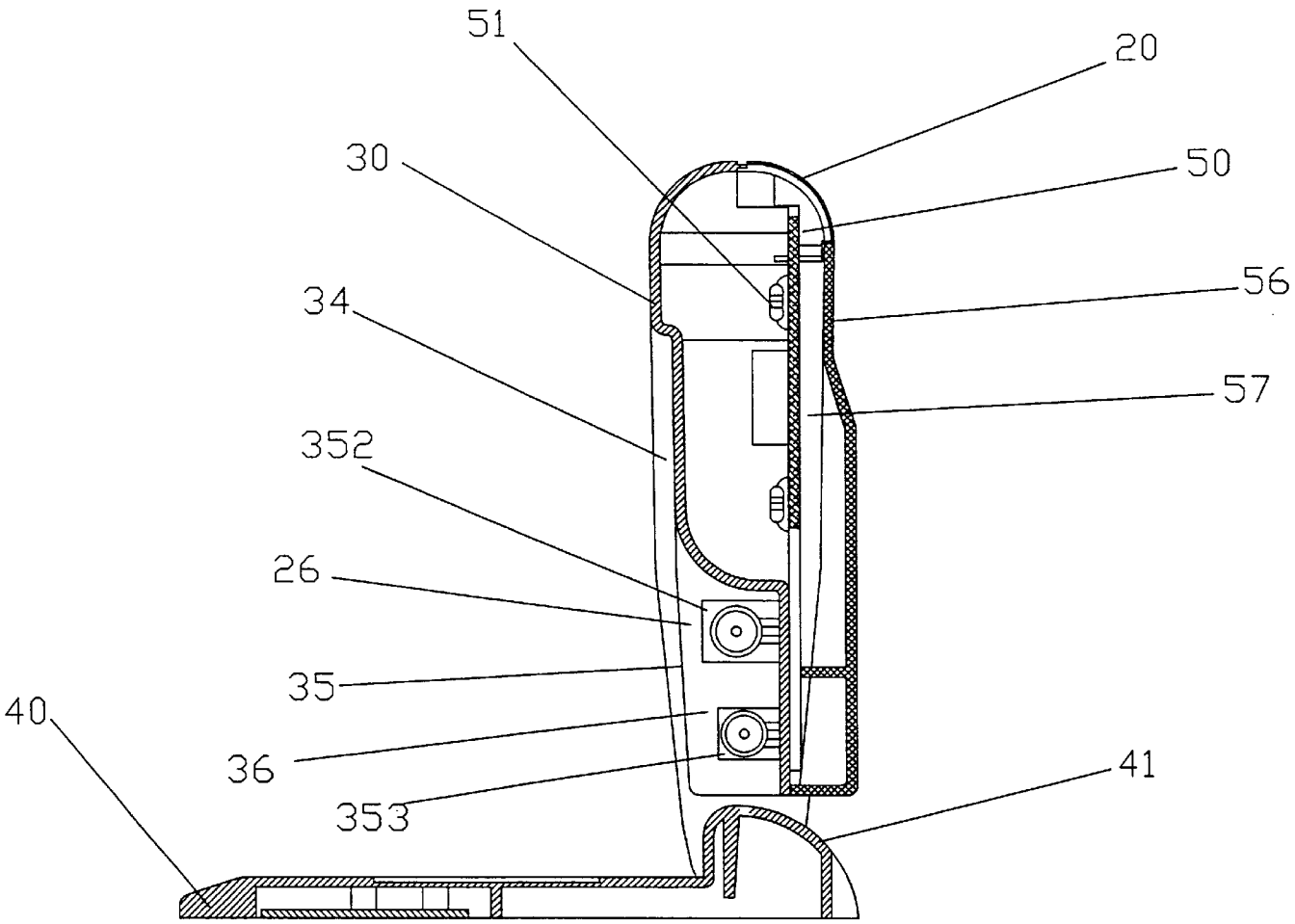
FIG. 3 is a side sectional view of the box in vertical position with the base seat.
Figure 4:
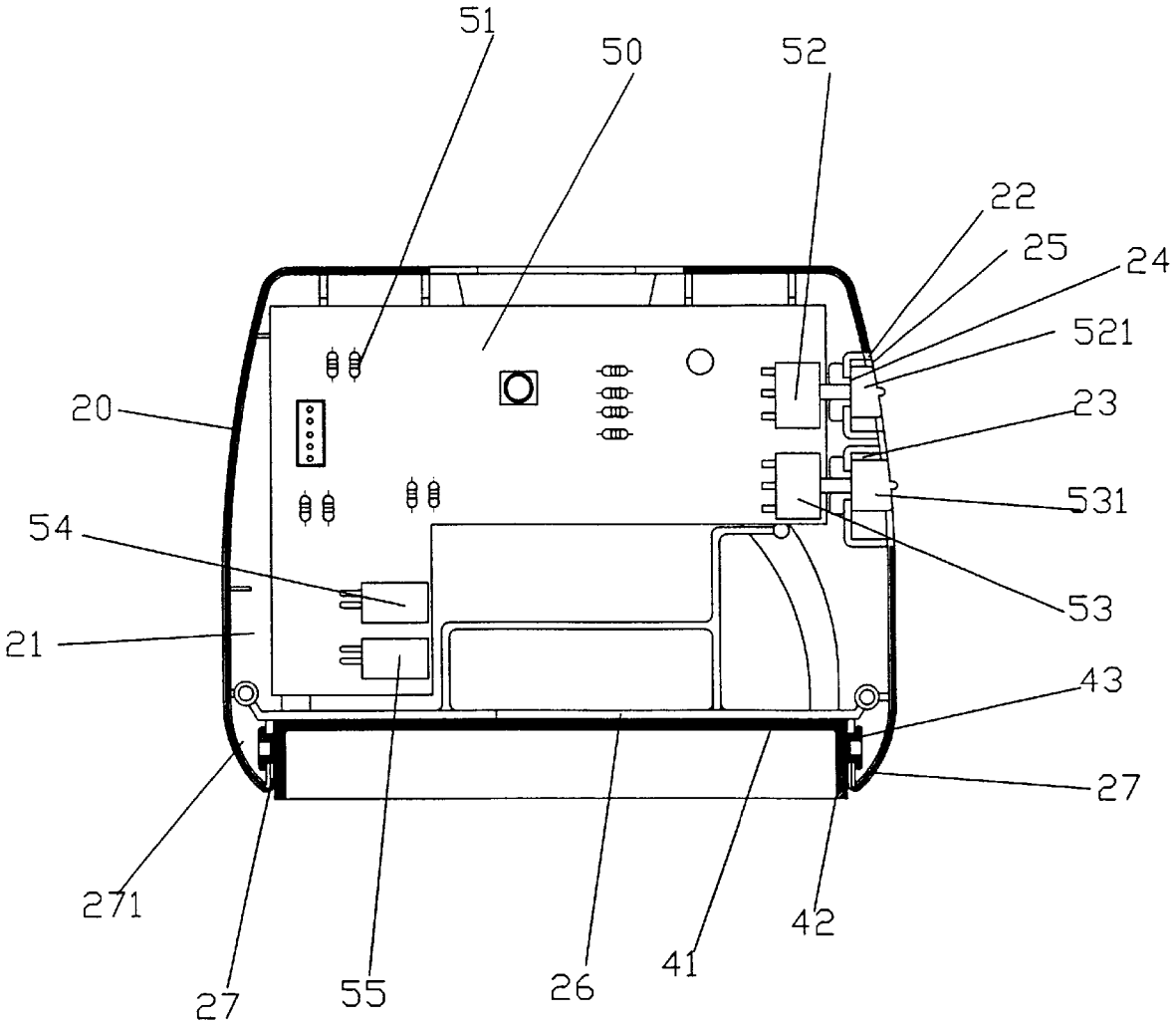
FIG. 4 is the upper view of PC board in the upper box.

Please refer to FIGS. 3 and 4: A practical example of the antenna device boxed structure includes an upper sheath (20), a lower sheath (30), a base seat (40) and a PC board (50). The upper sheath (20) has an appropriate deep storage space and two sliders (22)'(23) on the same side of the sheath. There are two slots (24)'(25) on the sliders. A groove (26) inside of the upper sheath (20) forms a concave space, and two bearings (27) are on both sides of the groove (26). The outside of the bearings is covered with arc shape concaves (271).

Figure 5:
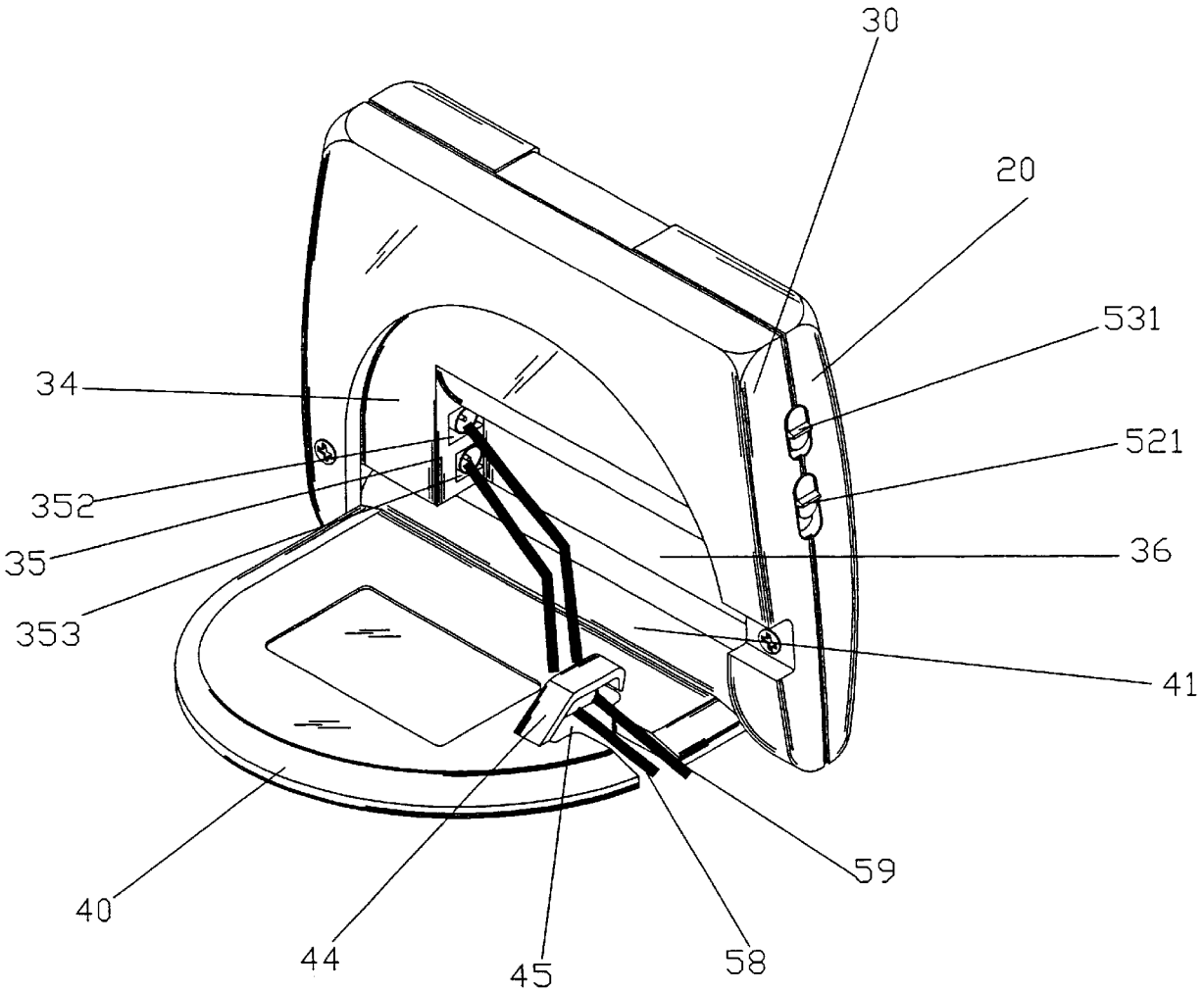
FIG. 5 is a three-dimensional view of the box in vertical position with the base seat.

Please refer to FIGS. 3 and 5. The lower sheath (30) is designed to match with the upper sheath (20). Accordingly, the two sheathes form a tightly covered box. There are two sliders on the same side, and two bearings on each side of the boxed structure. Grooves are designed on both sheathes (as the above-mentioned drawing) for space usages. The lower part of the lower sheath (30) has a semi-circle concave groove (34). An allowance gap (35) is formed in the inner edge of the concave groove as well as its outer edge is to form a concave space (36). There are two hollow holes (352)'(353) on one side of the allowance gap (35).

Figure 6:
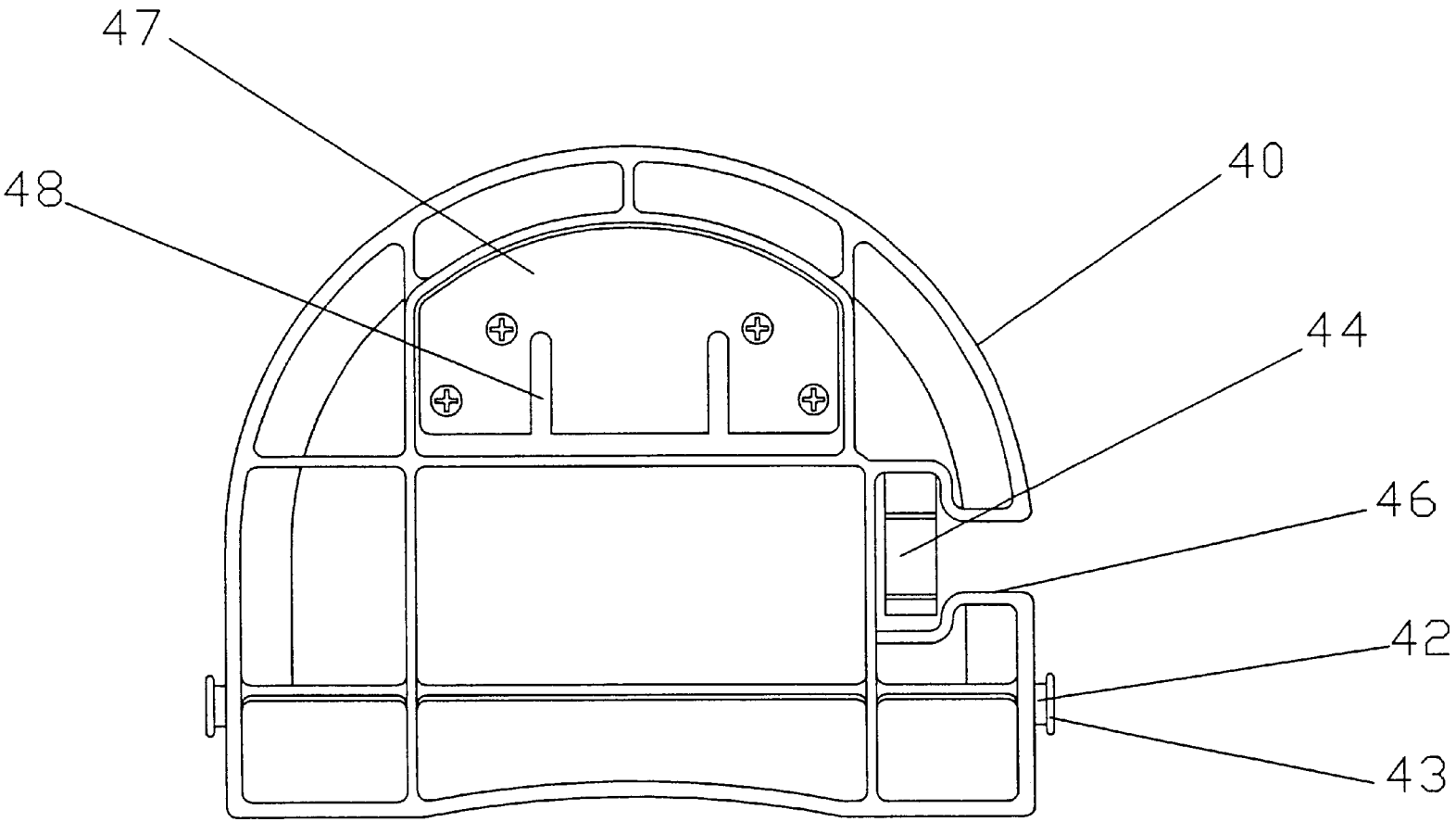
FIG. 6 is a bottom plan view of the base seat

Referring to FIG. 3 to FIG. 6, the base seat (40) is a semi-circle plate (FIG. 5) which can be put onto the concave groove (34) when approaching the box. On FIG. 3, the right side of the base seat is a convex block (41) with a shape which can be just fitted into the groove (26) of the box. Two protruded bars (42) (FIG. 4) are on two ends of the convex block (41). The edge of the protruded bars forms an appropriate circular convex flange (43) (FIG. 6). Referring to FIG. 5, on the base seat, a hub (44) is designed close to the base edge and forms a notch (45), and underneath the hub is a gap (46). Back to FIG. 6, a metal plate (47) is fixed on the bottom of the base seat (40), with some long grooves (48) on it (the example invention has two long grooves).

Refer now to the drawings FIGS. 3 and 4. The PC board (50) is located in the center of storage space (21) of the upper sheath (20). A certain number of electrical elements (51) are allocated on the board (50). The traces are conducted to form a control circuit loop to connect respectively with the sliders (22)'(23) to set the channel switch (52) and the power switch (53). Then connecting channel switch (52) with the switch block (521) fixed into the slider (22), and the power switch (53) with switch block (531) is fixed into the slider (23). On the other hand, the signal connector (54) and another power connector (55) on the PC board (50) should match perfectly with the corresponding hollow holes (352), (353) on the lower sheath (30). On FIG. 3, one radiant plate (56) is matched with an intermediate plate (57), then fixed to the PC board (50) as a three-layer-wafer. When plugging the terminals of the power cable (58) and the signal cable (59) into the signal connector (54) and the power connector (55), the loop will be connected completely.

According to the previous description of the assembly processes, the electrical element (51) installed on the PC board (50) forms an electrical loop. The radiant plate (56) and the intermediate plate (57) may approach the PC board (50), and be put as a whole into the storage space (21) of the upper sheath (20) by using screws. Meanwhile, the channel switch (52) and the power switch (53) should be fixed into the sliders (22)'(23) to match with the switch blocks (521) and (531). The two blocks (521) (531) protrude for easy manual operation.

Please continue with reference to FIGS. 4 and 5. The convex block (41) of the base seat (40) fits into the groove (26) of the upper sheath (20), and the protruded bar (42) of the convex block (41) couples with the bearings (27) on both sides of the groove (26). The convex flanges (43) of the protruded bar (42) contact the outside of the bearings (27), to avoid loosening in the above connection. Then the lower sheath (30) is covered with the upper sheath (20) to ensure the hollow holes (352)'(353) on the lower sheath (30) correspond with the signal connector (54) and the power connector (55) on the upper sheath (20). The invention can eliminate the conventional process in cables' penetration; therefore, the assembly is faster and more convenient than others.

The radiant plate (56) is firmly matched with the intermediate plate (57) as a wafer-layer to solidly join on the PC board (50) to form a position for the device of receiving and transmitting signals. Thus, there is no need to connect the cables during the operation of receiving and transmitting signals to reach the same purpose. Additionally, since the upper and lower sheaths (20) (30) correspond and match with the base seat (40), the whole boxed structure will be available for positioning and elevating. Moreover, as the convex block (41) of the base seat (40) is coupled with the groove (26) of the box, and since the materials are elastic and moldable, a smooth and quiet movement is achieved.

Referring to FIG. 5, the terminals of the power cable (58) and the signal cable (59) are connected to the signal connector (54) to conduct with the power connector (55). Thus, the power cable (58) and the signal cable (59) can directly pass through the hub (44) on the base seat (40) to provide a bundled function. Furthermore, since the base (40) is for rotating and regulating elevation, there is no interference to the power cable (58) and signal cable (59). So, whereas the conventional device is vulnerable to cables' damage, poor connection and disconnection, the present invention overcomes and solves these problems.

The PC board (50) securely adapts with the radiant plate (56) and the intermediate plate (57) to form a wafer-layer, which is assembled with the upper and lower sheaths (20)'(30) to connect with the base seat for convenience to freely regulate different elevations. Moreover, the base seat (40) can be easily rotated and regulated to form an appropriate angle for receiving and transmitting signals. Additionally, the concave space (36) of the lower sheath (30) can be lugged with the convex hub (44) of the base seat (40), to conveniently collect and receive the lower and higher sheaths (20) (30) and the base seat (40), while the device is not been used.

Another importance is that the metal plate (47) on the bottom of the base seat (40) can be adapted to receive a nail(s) on a wall or a ceiling by using the long grooves (48) of the metal plate (47) for lugging the nail(s). Thus, the box and the base seat 40 can be rotated and regulated in an appropriate angle for receiving and transmitting signals.

In summary, the invention concerns the PC board matched with the radiant plate jointing an intermediate plate in between as a wafer-layer assembled in the boxed structure. Thus, no cables connection procedure is needed during the assembling, which makes the assemble work easier and faster than before. Moreover, as the convex block (41) of the base seat (40) has been closely coupled with the groove (26) of the box, a drag is present to form a positional force in the structure, which makes for a smooth and quiet movement for adjusting the receiving and transmitting angles; also, positioning in different planes is possible. The novelty of this invention can meet the requirements of a new model utility patent application and is suitable for utilizing in industrial applications.

What is claimed is:

1. An antenna device boxed structure, comprising:

an upper sheath having a storage space and having a lateral groove to form two bearings;

a lower sheath closely shielded with the upper sheath, and having a concave groove to form a storage space for storing purposes;

a base seat having a convex block located at one of its end for matching with the lateral groove, and having a pair of protruded bars on bilateral sides of the block to connect with the bearings;

a PC board securely fixed in the storage space of the upper sheath;

an intermediate plate fixed on the PC board;

a radiant plate adopted with the intermediate plate; and a power cable and a signal cable connected with an electrical element to form a conducting loop;

wherein the PC board and the radiant plate with the intermediate plate as a whole are fixed between the upper and lower sheaths; the upper and lower sheaths being connected with the protruded bars of the base seat for positioning/packing or adjusting angles for receiving and transmitting signals;

and wherein the power cable and the signal cable are connected using a push and pull movement.

2. The device according to claim 1, further comprising a metal plate fixed on a bottom of the base seat, said metal plate having a plurality of long grooves adapted for hanging the device on different planes.

3. The device according to claim 1, wherein the convex block of the base seat is matched with the concave groove of the lower sheath, and the lateral groove of the upper sheath, and being formed of plastic, wherein friction between the convex block and the lateral groove creates an adequate resistance for holding and positioning the antenna device.

4. The device according to claim 2, wherein the convex block of the base seat is matched with the concave groove of the lower sheath, and the lateral groove of the upper sheath, and being formed of plastic, wherein friction between the convex block and the lateral groove creates an adequate resistance for holding and positioning the antenna device.

* * * * *